US005360481A

United States Patent [19]

Ludwig

[11] Patent Number: 5,360,481

[45] Date of Patent: Nov. 1, 1994

[54] APPARATUS FOR COATING A SUBSTRATE WITH A SUBSTANCE

[76] Inventor: Volker Ludwig, Untere Muhlewiesen 10, 7896 Wutoschingen, Germany

[21] Appl. No.: 988,186

[22] Filed: Dec. 9, 1992

[30] Foreign Application Priority Data

Dec. 10, 1991 [DE] Germany ..... 4140652

[51] Int. Cl.[5] ..... B05C 5/02

[52] U.S. Cl. ..... 118/50; 118/213; 118/253; 118/406; 118/419

[58] Field of Search ..... 118/50, 62, 419, 213, 118/253, 301, 406

[56] References Cited

U.S. PATENT DOCUMENTS 4,341,580 7/1982 Ahmed et al ..... 156/582 X 4,761,309 8/1988 Embry ..... 118/62 X 4,791,879 12/1988 Eklund et al. ..... 118/50

5,094,886 3/1992 Bogardy ..... 118/50 X

*Primary Examiner*—David A. Simmons

*Assistant Examiner*—Paul M. Rivard

*Attorney, Agent, or Firm*—Bachman & LaPointe

[57] ABSTRACT

In the case of an apparatus for coating a substrate with a substance, in particular a film with an adhesive, the substance is applied by means of a feeding head (4) through perforations (5) of a template (2) to the substrate in interaction with a backing roll (3) or the like within a coating nip (8). In this arrangement, the backing roll (3) has a screening cover (7) with holes (12). A radially aligned suction stream is generated in the backing roll in a region in and/or after the coating nip (8).

2 Claims, 2 Drawing Sheets

APPARATUS FOR COATING A SUBSTRATE WITH A SUBSTANCE

The invention relates to an apparatus for coating a substrate with a substance, in particular a film with an adhesive, the substance being applied by means of a feeding head through perforations of a template to the substrate in interaction with a backing roll or the like within a coating nip.

Such apparatuses are known in varied form and design. Just by way of example, reference is made here to German Offenlogungsschrift 3,905,342, which shows a perforated cylinder in interaction with a backing roll, between which a substrate is passed through and coated with a substance. As a rule, the substance, which may be, for example, a thermoplastic material, is previously melted, so that its application to the substrate takes place in the liquid state of aggregation.

Such apparatuses serve not only for coating textile substrates, but for example also for coating films with an adhesive or the like. All these application possibilities are to be covered by the present invention.

However, the coating of films in particular presents considerable problems. The films are usually very thin webs which are passed through between template and backing roll. It is not alone sufficient here that the film is guided in the coating nip, rather it should also undergo a certain tensile stress in order that it does not deform during the coating operation. In this respect, it should particularly be taken into consideration that the film is subjected to heat in the coating nip, since the template is warmed on account of the melted substance.

This is a reason why the film is not drawn out directly from the coating nip but remains on the backing roll after the coating nip and is lifted off the backing roll only after a certain circumferential region. This has the effect that the film is already cooled, so that it can again undergo higher tensile forces. This is important in particular because the force by means of which the substrate is held against the backing roll results from the web or tensile stress after the backing roll and the friction of the substrate on the backing roll. If, for example, no tensile stress is exerted, the frictional force is also lost as guidance for the film, However, a considerable force of attraction is exerted on the film from sides of the template. The template, usually a metal cylinder, has perforations, the inner surface area of which is, as a rule, a multiple of the surface area with which the substance to be applied is in connection with the substrate. These perforations produce very high forces of adhesion, so that a considerable force has to be expended in order to draw the substance out of the perforation by means of the substrate. If the film does not have sufficient hold on the backing roll, i.e. if there is not sufficient tensile stress and also not sufficient friction, the film remains on the template or forms a trailing bulge.

The present invention is based on the object of developing an apparatus of the abovementioned type by means of which an adhesion of the substrate on the backing roll and consequently a reliable drawing-off of the substrate from the template is ensured.

To achieve this object, the backing roll has a screening cover with holes and a radially aligned suction stream is generated in the backing roll in a region in and/or after the coating nip.

This means that a vacuum is built up within the screening cover, at least in a partial region, and has the effect through the holes of the substrate being drawn against the screening cover. Consequently the question of tensile or web stress is no longer of decisive importance, since the friction of the substrate on the backing roll is intensified quite considerably by the built-up vacuum. The effect is also independent of whether the film is warm, and consequently loses tensile strength, after the coating nip. In any event, it is ensured that the film remains on the backing roll, i.e. the substance is drawn out of the perforation of the template immediately after the coating nip.

It should be expressly pointed out that, within the scope of the present invention, the configuration of the backing roll and template is of secondary importance. It is also in the scope of the invention that, for example, the template and/or backing roll runs as an endless band over rollers, so that they form a planar coating nip for the substrate. All these configurations are to be covered by the present inventive idea.

As a rule, it should suffice that the substrate is subjected to the suction stream only in a partial circumferential region of the backing roll. This depends in particular on which forces of adhesion are to be exerted on the substrate.

Since the substrate is to be drawn off the backing roll after a certain circumferential region, it proves to be advisable to neutralize the vacuum, at least in this region, in order to facilitate the lifting off of the substrate from the backing roll. This lifting-off can be further assisted by, for example, compressed air being discharged through the holes of the screening cover in this region, which assists a lifting-off of the substrate.

In order that not the entire backing roll or too large a partial space is subjected to a vacuum or compressed air, it should be advisable to provide inside the screening cover a ring which is subdivided into chambers, at least in partial regions. These chambers are bounded by chamber walls, on which the screening cover is then guided. In this case, the chamber walls may either be firmly connected to the screening cover and brush past an inner roll during turning of the screening cover. Another possibility, however, is to insert the chamber walls in an inner roll, so that the screening cover runs on the chamber walls. Further configurations are undoubtedly also conceivable here and these are likewise to be covered by the inventive idea.

Since a wide coating nip is preferably formed between backing roll and template, as already described in German Offenlegungsschrift 3,905,342, the chamber walls should be flexibly designed, at least in the region of this coating nip, since the screening cover bears against the template in this coating nip. As a result, both the coating of the substrate and its guidance are substantially improved.

In this context, the inventor has also developed a further application of the apparatus for coating a substrate with a substance, which however can also be put into practice independently of this coating possibility. In many cases it is necessary to bring plastic into a particular form. This may be, for example, plastic platelets, which are then sent for further use or processing. This problem is particularly important in the reprocessing of plastic or during disposal. Normally, such plastic scrap is ground, shredded or otherwise comminuted. According to the present invention, on the other hand, the plastic is melted and introduced through the feeding head into the perforations of the template against the pressure of the backing roll. It remains there for a short time during turning of the template and can solidify. Then, the perforations are assigned a device for discharging the plastic out of the perforations. This device may, for example, be a spiked roll which pierces the perforations with its spikes and thereby discharges the plastic as plastic platelets. This spiked roll may then, incidentally, also be used at the same time as the drive for the template.

In the case of a further embodiment, the perforations are subjected to compressed air, in particular pulsating compressed air, from the inside, so that in this way the plastic is forced out of the perforations and is collected in an appropriate catching container. This plastic can then be sent for further use or re-use or for disposal.

Further advantages, features and details of the invention emerge from the following description of preferred illustrative embodiments as well as with reference to the drawing, in which:

FIG. 3 shows a cross section through a further embodiment of an apparatus according to the invention for coating a substrate for further use.

Figure 1:
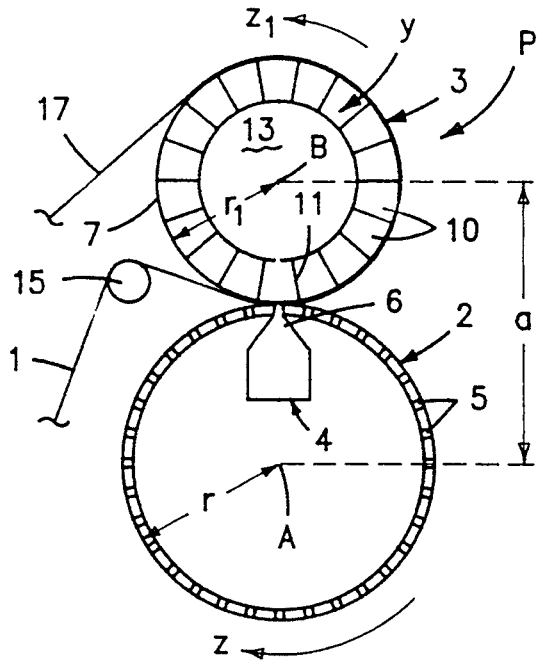
FIG. 1 shows a diagrammatically represented cross section through an apparatus according to the invention for coating a substrate.

An apparatus P according to the invention for coating a substrate 1, in particular a film, has according to FIG. 1 a template 2, which interacts with a backing roll 3. In the template 2 there is a feeding head 4, by means of which a melted substance (not shown in any more detail) is applied through perforations 5 to the substrate 1. For this purpose, the feeding head 4 is provided with appropriate channels and a nozzle mouth 6, a further development of the feeding head 4, assumed as known, not being intended to be described in any more detail here.

In the present case, the template 2 is designed as a preferably metallic cylinder, the perforations 5 being formed in this metallic cylinder, and this metallic cylinder turning in direction z about an axis of rotation A. Appropriate driving members for the template 2 are likewise omitted for the sake of clarity. However, it has a radius r which is large enough for the feeding head 4 to be accommodated in any event.

Interacting with the template 2 is the backing roll 3, which turns in direction $z_1$ about its axis B. In this arrangement, the backing roll 3 has a cover 7, which is designed as a screen, i.e. is likewise penetrated by perforations. The radius $r_1$ denotes the radius of the backing roll 3, i.e. the distance of the axis of rotation B from the screening cover 7.

In the present illustrative embodiment, the axis of rotation A of the template 2 is arranged underneath the axis of rotation B of the backing roll 3. It goes without saying that the inventive idea also covers a converse arrangement. However, the axis of rotation A should preferably maintain a distance a from the axis of rotation B which is less than the sum of the two radii r and $r_1$. This results, as represented in particular in FIG. 2, in the screening cover 7 bearing in a certain region b during interaction with the template 2 against this template 2 and a lengthened coating nip 8 being formed in this way. In the region of this coating nip 8, the substrate 1 is passed between template 2 and backing roll 3.

In the present illustrative embodiment, inside the backing roll 3 there is formed a ring 9, which is subdivided into chambers 10. For this purpose, chamber walls 11 are provided. It can be seen in FIG. 2 that holes 12 are provided in the screening cover 7 in the region of the chambers 10, through which holes either air can be sucked into the chambers 10 or else air can be blown out of the chambers 10. The point of sucking in air or blowing out air is described further below.

How the chambers 10 are produced should be of secondary importance. It is, for example, conceived of to form the interior of the backing roll 3 as a rubber-covered roll, in the rubber cover 14 of which the chamber walls 11 are inset as material strips, for example of sheet metal. The screening cover 7 is then pushed onto these sheet-metal strips and turns in direction $z_1$.

Figure 2:
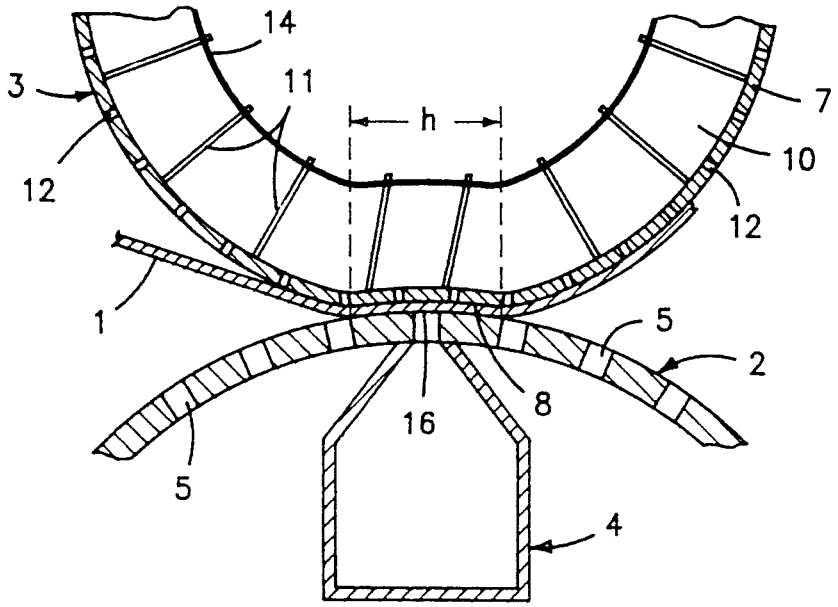

However, it is also conceivable for the chamber walls 11 to be connected to the screening cover 7 and to brush along the roll 3. However, if the region b described above is formed, within which region the screening cover 7 bears against the template 2 over a wider coating nip 8, it must in any event be ensured that the chamber walls or their mounting yields. This is indicated in FIG. 2 and can be achieved in a simple manner with the rubber cover 14 of the rubber-covered roll 13, the chamber walls 11 then being positioned obliquely in the direction of rotation.

In the present illustrative embodiment, the substrate 1 is led over a roller 15 before it enters into the coating nip 8. Thereafter, the substrate 1 bears against the backing roll 3 and is led over a substantial part of the circumference of the backing roll 3 before it lifts off the backing roll 3 and is sent for further processing or use.

The operating principle of the present apparatus according to the invention for coating a substrate is as follows:

As known and indicated above, the substance to be applied is forced out of the feeding head 4 through the nozzle mouth 6 into a perforation 5 and comes into contact with the substrate 1. However, the contact surface area 16 is relatively small in relation to the surface area with which the substance inside the perforation 5 is in contact with the template 2. In other words, the forces of adhesion of the perforations 5 are very high. This has the consequence that the substrate 1 tends to remain adhering to the template 2, so that other possibilities have to be sought in order that the substrate 1 can be lifted off the template 2 together with the coating once the substrate has been coated with the substance.

This purpose is served firstly by the substrate 1 wrapping to a great extent around the backing roll 3. The force which holds the substrate 1 on the backing roll 3 results from the web stress during drawing-off of the substrate 1 from the backing roll 3 and the friction of the substrate 1 on the backing roll 3. If, for example, the web stress approaches zero, the friction of the substrate on the backing roll 3 also approaches zero. Consequently, the force which holds the substrate 1 on the backing roll 3 is missing and the substrate 1 remains on the template 2 for an undesirably long time, it being possible for considerable bulges to form.

If, for example, very thin films, such as diaper films, are to be coated with a substance, these films cannot be subjected to a high web or tensile stress, which would actually be required in order to hold the film on the backing roll 3. There is also the fact that the film is heated up within the coating nip 8, and once again loses tensile strength as a result. Therefore, until now it was not possible to coat such thin films with a normal template and backing roll.

According to the present invention, however, a vacuum is generated in the chambers 10 in the region b of the coating nip 8 and thereafter, so that radially directed forces act on the substrate 1 and hold this substrate 1 firmly on the backing roll 3. It is in fact sufficient if only a few chambers in and after the coating region are subjected to a vacuum, practice revealing how many of such chambers are necessary within the backing roll 3. It goes without saying that, the more chambers are subjected to a vacuum, the firmer the substrate 1 is held on the backing roll 3.

In the present example, the ring 9 is subdivided completely into chambers 10. This is only to be understood by way of example, since just one or a number of chambers after the coating nip 8 could also suffice. However, it is also conceived of to effect the lifting-off of the substrate from the backing roll 3 not only by neutralizing the vacuum in the chambers provided there, if any are provided, but by subjecting the corresponding chamber or chambers to compressed air in this drawing-off region 17, so that the substrate 1 is, as it were, blown off the backing roll 3 from inside.

It is to be regarded as a further positive feature that the backing roll 3 is preferably cooled, so that this alone already has the result of increasing the tensile strength of the substrate 1. This is to be understood as an improved embodiment.

Figure 3:
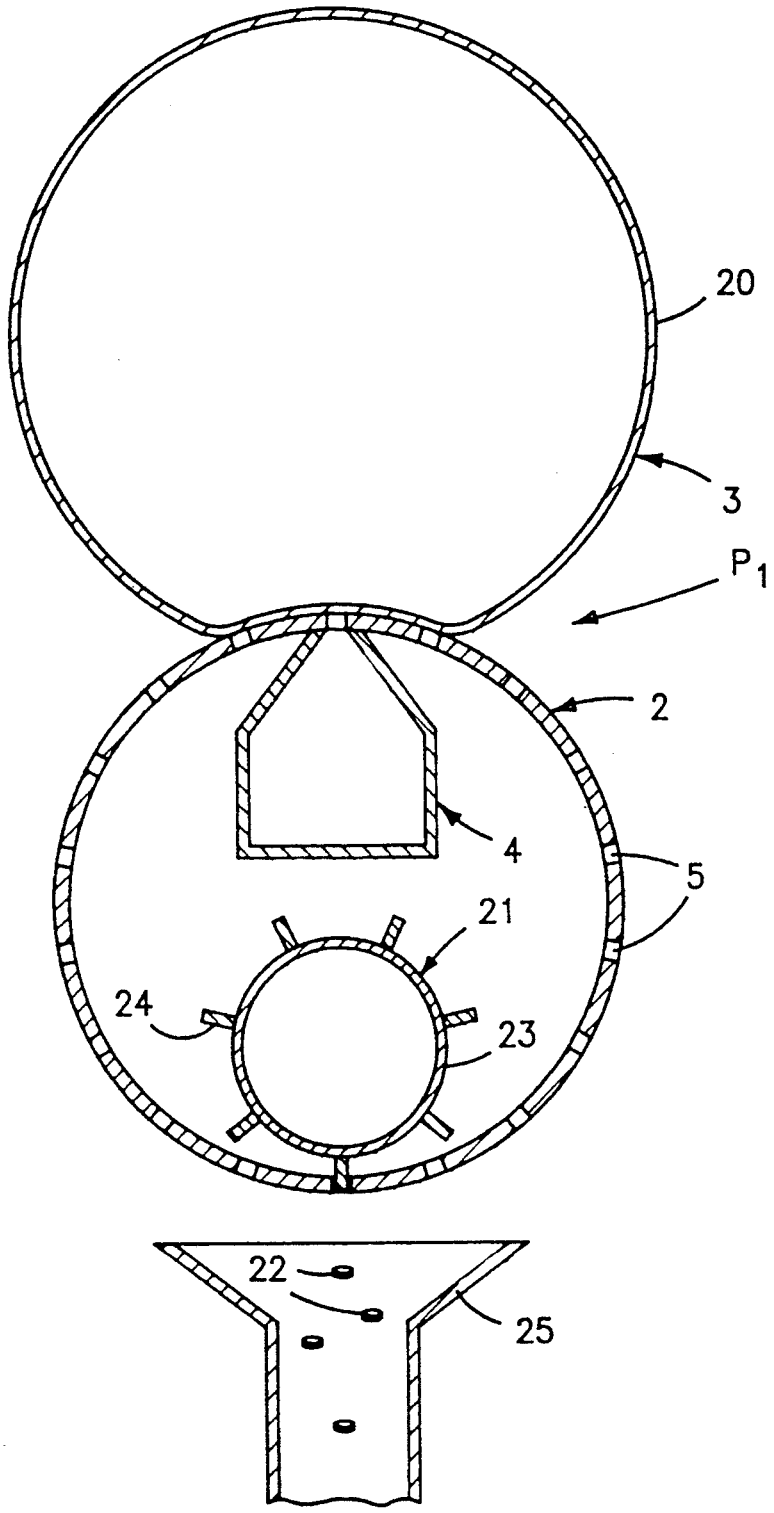
FIG. 3 shows an enlarged partial region of the cross section from FIG. 1.

In FIG.3, a quite different use of an apparatus $P_1$ for coating a substrate is presented. In this case, the template 2 again interacts with a backing roll 3, which however merely has a cover 20, which is preferably smooth and does not offer any possibility of adhesion for a substance to be discharged from the feeding head 4. Since the coating of a substrate is not intended in the case of the novel use, the backing roll 3 also need not necessarily have an indicated region b in which it bears against a part of the cover 20 of the template 2. All that is essential is that a melted substance is introduced from the feeding head 4 into the perforation 5, any flowing-out of the substance from the perforation 5 being avoided by the backing roll 3. The backing roll 3 may also be an endless band or the like.

Since the substance does not adhere to the backing roll 3, it remains in the perforations 5 and solidifies during the turning of the template 2. Provided underneath the feeding head 4 is a devide 21 for discharging substance platelets 22. In the illustrative embodiment shown, the device for discharging the substance platelets 22 is a spiked roll 23, which engages with appropriate spikes 24 in the perforations 5. However, the device for discharging may also be nozzles from which compressed air is discharged in a pulsating manner, which air then forces the substance platelets 22 out of the perforations 5.

An appropriate funnel 25 is provided for catching the substance platelets 22.

I claim:

1. An apparatus for coating a substrate with a substance comprising:

a hollow backing roll having an inner wall and an outer perforated surface spaced from the inner wall and defining therebetween a compartment;

a plurality of radially extending flexible walls between said inner wall and said perforated surface for dividing said compartment into a plurality of chambers;

a vacuum source associated with at least one of said plurality of chambers for drawing air through the perforated surface of the hollow backing roll;

template means arranged adjacent said hollow backing roll and defining therebetween a coating nip, said template having a plurality of perforations;

substance feeding means associated with said template for feeding the substance to be applied to the substrate through said plurality of perforations to said coating nip wherein said outer perforated surface of said hollow backing roll yields in the area of the coating nip.

2. An apparatus according to claim 1 including a compressed air source associated with at least one of said plurality of chambers for feeding compressed air to the perforated surface of said hollow backing roll for drawing off the coated substrate.

* * * * *